US007583233B2

(12) United States Patent
Goldberg et al.

(10) Patent No.: US 7,583,233 B2
(45) **Date of Patent: *Sep. 1, 2009**

(54) RF RECEIVING AND TRANSMITTING APPARATUSES HAVING A MICROSTRIP-SLOT LOG-PERIODIC ANTENNA

(75) Inventors: Mark Russell Goldberg, Simi Valley, CA (US); Harold Kregg Hunsberger, Simi Valley, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 14 days.

This patent is subject to a terminal disclaimer.

(21) Appl. No.: 11/861,477

(22) Filed: Sep. 26, 2007

(65) Prior Publication Data

US 2008/0007471 A1 Jan. 10, 2008

Related U.S. Application Data

(63) Continuation-in-part of application No. 11/163,119, filed on Oct. 5, 2005, now Pat. No. 7,292,197.

(60) Provisional application No. 60/617,454, filed on Oct. 8, 2004.

(51) Int. Cl.
*H01Q 11/10* (2006.01)
*H01Q 13/10* (2006.01)

(52) U.S. Cl. ..... 343/792.5; 343/767; 343/700 MS; 343/770

(58) Field of Classification Search ..... 343/792.5
See application file for complete search history.

(56) References Cited

U.S. PATENT DOCUMENTS

| | | | | |
|---|---|---|---|---|
| 3,369,243 | A | 2/1968 | Greiser | |
| 3,696,438 | A | 10/1972 | Ingerson | |
| 3,732,572 | A * | 5/1973 | Kuo | 343/792.5 |
| 4,336,543 | A | 6/1982 | Ganz et al. | |
| 4,594,595 | A | 6/1986 | Struckman | |
| 4,901,011 | A * | 2/1990 | Koike et al. | 324/757 |
| 4,922,262 | A * | 5/1990 | Chow | 343/770 |
| 5,057,850 | A * | 10/1991 | Kuo | 343/792.5 |
| 6,703,975 | B1 | 3/2004 | Freeman | |
| 7,256,751 | B2 * | 8/2007 | Cohen | 343/792.5 |
| 7,292,197 | B2 * | 11/2007 | Goldberg et al. | 343/792.5 |

FOREIGN PATENT DOCUMENTS

EP 1646110 A1 4/2006

OTHER PUBLICATIONS

Johnson, Richard C., "Antenna Engineering Handbook", 1993, pp. 14-32 to 14-53, Third Edition, McGraw-Hill, Inc.

Gauthier, G. et al., "W-Band Finite Ground Coplanar Waveguide (FGCPW) to Microstrip Line Transition," IEEE Microwave Digital Archive, 1998 [CD-ROM], Ref. No. 0-7803-4471-5/98.

(Continued)

*Primary Examiner*—Trinh V Dinh
(74) *Attorney, Agent, or Firm*—TraskBritt

(57) ABSTRACT

A log-periodic antenna having a layer of dielectric media interposed between a microstrip log-periodic portion and a slot log-periodic portion where an array of two or more log-periodic antennas that may be placed about vehicles, such as air vehicles, or mounted on stationary structures, such as communication towers.

24 Claims, 14 Drawing Sheets

OTHER PUBLICATIONS

Wiatr, W., "Coplanar-Waveguide-To-Microstrip Transition Model," IEEE Microwave Digital Archive, 2000 [CD-ROM], Ref. No. 0-7803-5687-X/00.

Godshalk,E.et al., "Characterization Of Surface Mount Packages At Microwave Frequencies Using Wafer Probes"IEEE Microwave Digital Archive,2000[CD-ROM],Ref. No. 0-7803-5687-X/00.

Ellis, T. et al., "A Wideband CPW-to-Microstrip Transition For Millimeter-Wave Packaging,"IEEE Microwave Digital Archive 1953-2000,1999[CD-ROM],Ref. No. 0-7803-5135-5/99.

Raskin, J., "Mode Conversion at GCPW-to-Microstrip-Line Transitions," IEEE, Jan. 2000, pp. 158-160, vol. 48, No. 1, Ref. No. 0018-9480/00.

Del Rio, David A., et al., "Ways to Improve the Radiation Pattern of a LPFSA," Antennas and Propagation Society Symposium, IEEE Washington, DC, Jul. 3-8, 2005; IEEE, US, vol. 1B, Jul. 3, 2005, pp. 410-413.

Partial European Search Report for European Application No. 08010594.3, dated Feb. 12, 2009.

* cited by examiner

RF RECEIVING AND TRANSMITTING APPARATUSES HAVING A MICROSTRIP-SLOT LOG-PERIODIC ANTENNA

CROSS-REFERENCE TO RELATED APPLICATIONS

This application is a continuation-in-part of application Ser. No. 11/163,119, filed Oct. 5, 2005, now U.S Pat. No. 7,292,197, issued Nov. 6, 2007, which claims the benefit of U. S. Provisional Patent Application Ser. No. 60/617,454, filed Oct. 8, 2004, the disclosures of which are hereby incorporated by reference herein, in their entirety, for all purposes.

BACKGROUND

The present invention, in its several embodiments, relates to receiving and transmitting apparatuses that include microstrip log-periodic antennas and, more particularly, to such apparatuses that include microstrip-slot log-periodic antennas.

The present practicable range of radio frequency (RF) is approximately 10 kHz to 100 GHz, i.e., 0.01 to 100,000 MHz. Within this frequency range electromagnetic radiation may be detected, typically by an antenna, and amplified as an electric current at the wave frequency. When energized via electric current at an RF wave frequency, an antenna may emit in the RF electromagnetic radiation at the RF wave frequency. Log-periodic antennas are typically characterized as having logarithmic-periodic, electrically conducting, elements that may receive and/or transmit communication signals where the relative dimensions of each dipole antenna element and the spacing between elements are logarithmically related to the frequency range over which the antenna operates. Log-periodic dipole antennas may be fabricated using printed circuit boards where the elements of the antenna are fabricated in, conformal to, or on, a surface layer of an insulating substrate. The antenna elements are typically formed on a common plane of a substrate such that the principal beam axis, or direction of travel for the phase centers for increasing frequency of the antenna, is in the same direction. The antenna elements may be placed in electrical communication with an RF receiver and/or an RF transmitter. The analog and digital processing of the detected RF waveform is typically performed by an RF receiver and the analog and digital processing of the transmitted RF waveform is typically performed by an RF transmitter.

SUMMARY OF THE INVENTION

The invention in its several embodiments includes radio frequency (RF) receiving and/or transmitting systems or apparatuses having a log-periodic antenna having a dielectric medium such as a printed circuit board interposed between a microstrip log-periodic portion and a proximate slot log-periodic portion. A perimeter of the microstrip log-periodic portion may be undersized relative to a perimeter of a first slot log-periodic antenna portion and a proximate distance between an outer perimeter of the first microstrip log-periodic antenna portion and the perimeter of the first slot log-periodic antenna portion, perpendicular to a second surface may be referenced to bound a first impedance gap. The invention in its several embodiments may further include an antenna having a curvilinear, electrically conductive feed line and a substantially co-extensive curvilinear slot transmission line. Embodiments of the invention may further include an array of two or more log-periodic antennas mounted in alternating phase center orientations. Accordingly, a log-periodic antenna element having a layer of dielectric media interposed between a microstrip log-periodic portion and a slot log-periodic portion may be disposed in an array having two or more like elements that may be placed about vehicles, such as land vehicles, water vehicles and air vehicles, or mounted on stationary structures, such as communication towers. In addition, single or pairs of elements may be mounted to mobile receiving, transmitting, and/or transceiving apparatuses such as vehicles and human-portable interface devices such as mobile telephones and wireless personal data assistants.

BRIEF DESCRIPTION OF THE DRAWINGS

Reference is now made to the following description taken in conjunction with the accompanying drawings, in which.

Figure 1:
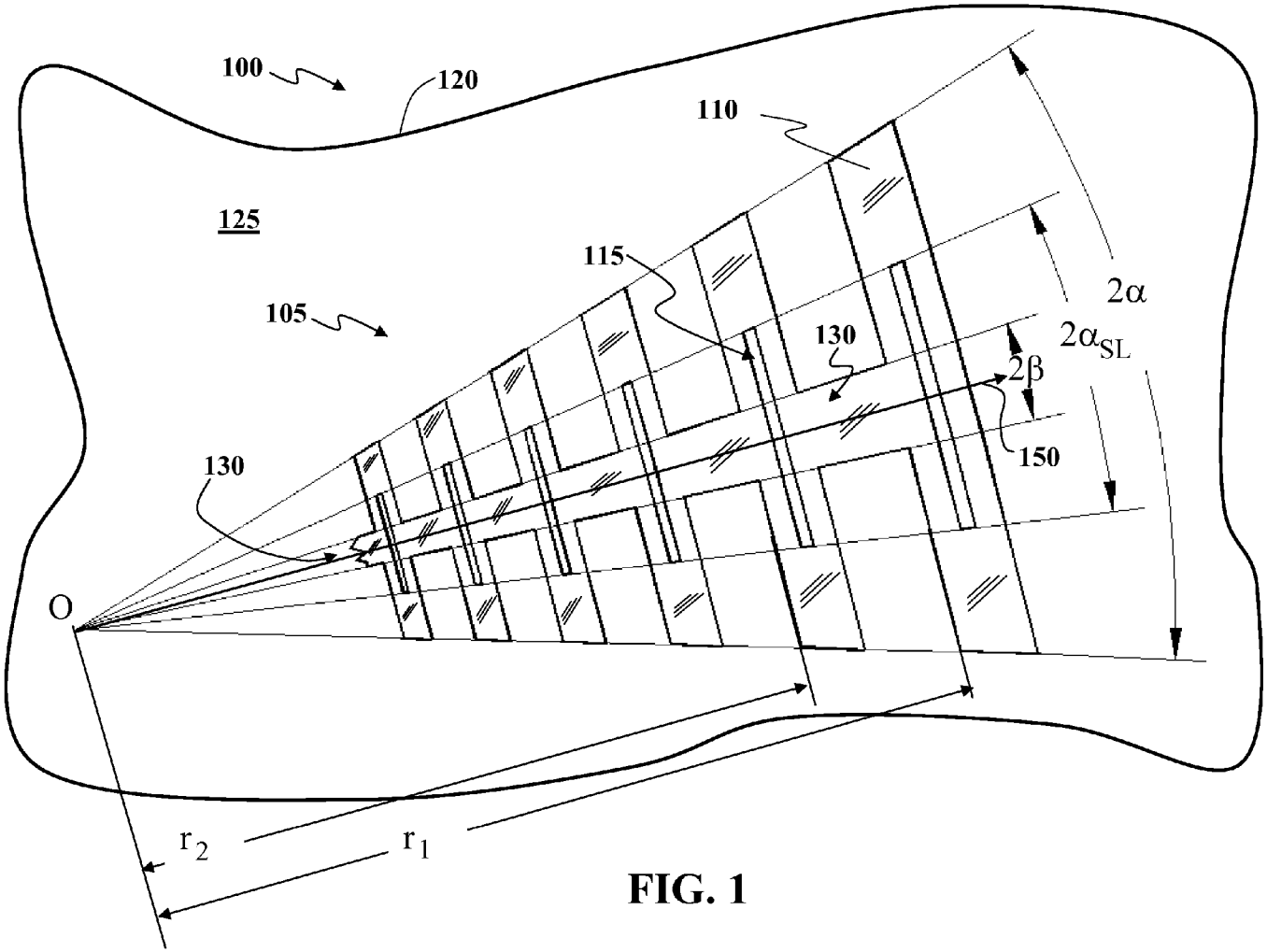
FIG. 1 illustrates in a plan view an example element of a printed circuit and transmission line characteristics of a microstrip line log-periodic array feed side of the present invention.

As used herein, the term "exemplary" means by way of example and to facilitate the understanding of the reader, and does not indicate any particular preference for a particular element, feature, configuration or sequence.

DETAILED DESCRIPTION

The present invention, in its several embodiments, include a log-periodic antenna having microstrip slot elements on a first, or top, side of a dielectric medium and a slot ground plane of the elements on a second, or bottom, side of the dielectric medium, where the radiating elements are oriented with alternating and opposing phases, e.g., 180 degrees phase differences, and where the combination may operate as a broadband log-periodic antenna. In addition, the present invention in its several embodiments may have a grounded modified semi-coplanar waveguide-to-microstrip line transition. A feed input of some embodiments typically has a transition from an unbalanced microstrip transmission line and may have a microstrip feed transmission line tapering from a base microstrip slot dipole element on a top side of the dielectric medium and a slotted ground plane under the transmission line tapering from a primary slot dipole element in a ground plane medium on the bottom side of the dielectric medium. Exemplary embodiments of the microstrip transmission line have a primary conductor strip in voltage opposition to a reference ground plane with an interceding dielectric between the two conductors. For example, the element embodiment may be fed by two slot lines in parallel that have as a common potential a main conductor. The main conductor typically tapers to a width that sets an impedance of the microstrip transmission line and along the same length, a void or slot in the ground plane is tapered to a zero width or corner point. In some embodiments, these tapered regions operate to transition the field line from being substantially between the microstrip conductor and the ground plane as in a capacitor, to being substantially fringing fields between the edges of the conductors passing through the dielectric.

Exemplary array embodiments of the present invention typically include an array of at least a pair of substantially frequency-independent planar antenna array elements where a first member of the pair of antenna array elements has a phase center axis substantially opposite in direction to the phase center axis of a second member of the pair of antenna array elements. The antenna element patterns may be aligned, i.e., top plan-form relative to bottom plan-form, which forms a microstrip log-periodic array (MSLPA) having a principal axis. Each MSLPA typically includes a slot transmission line running along the principal axis of the MSLPA that may function as feeds for the slot dipole elements the typically trapezoidal elements emanating in bilateral symmetry from the transmission line. In some embodiments, parasitic, or center, microstrip lines or slots may be interposed within the regions formed by the slot dipole elements and the transmission line of the combined layers. The outer perimeter of the feed side of the MSLPA typically describes a pattern or plan-form, the ground plane side of the log-periodic slot array typically then covers a pattern of the perimeter of each feed side microstrip line element of the top side and along with some additional width at substantially perpendicular to the perimeter to establish an impedance slot.

FIG. 1 illustrates an exemplary microstrip dipole element array and transmission line characteristics of a microstrip log-periodic array embodiment 100 of the present invention that is typically affixed on a first or top surface 125, or front side, of a dielectric medium 120, such as a printed circuit board. The transmission line portion 130 of the exemplary array is within the region subtended by the angle $2\beta$. The log-periodic array of the exemplary embodiment is typically symmetric in a plane about a principal axis 150 where the dipole elements extend as trapezoidal portions bounded, in this example, by the angle $2\alpha$. Generally, an internal centered slot 115 is provided by the pattern of the microstrip line at each element and may cross or traverse the transmission line portion 130. The pattern of a microstrip portion 105 of the MSLPA 100 may be a thin metallic film and the internal centered slot 115 may be fashioned by a trapezoidal region absent of the metallic film. The transverse extent of each interior slot, in this example, is bounded by the angle $2\alpha_{SL}$. For purposes of illustrating proportions of the microstrip elements of the antenna, the dipole elements, or dipole teeth of the array that may traverse transmission line portion are numbered starting with the dipole of largest wavelength. For example, a first dipole element 110 is shown with the longest span, i.e., the longest portion traversing the transmission line portion 130. The exemplary minimal radial distance from the reference origin, O, for the microstrip portion of the first dipole element 110 may be represented as $r_1$ and the minimal radial distance for the second dipole element may be represented as $r_2$.

Figure 2:
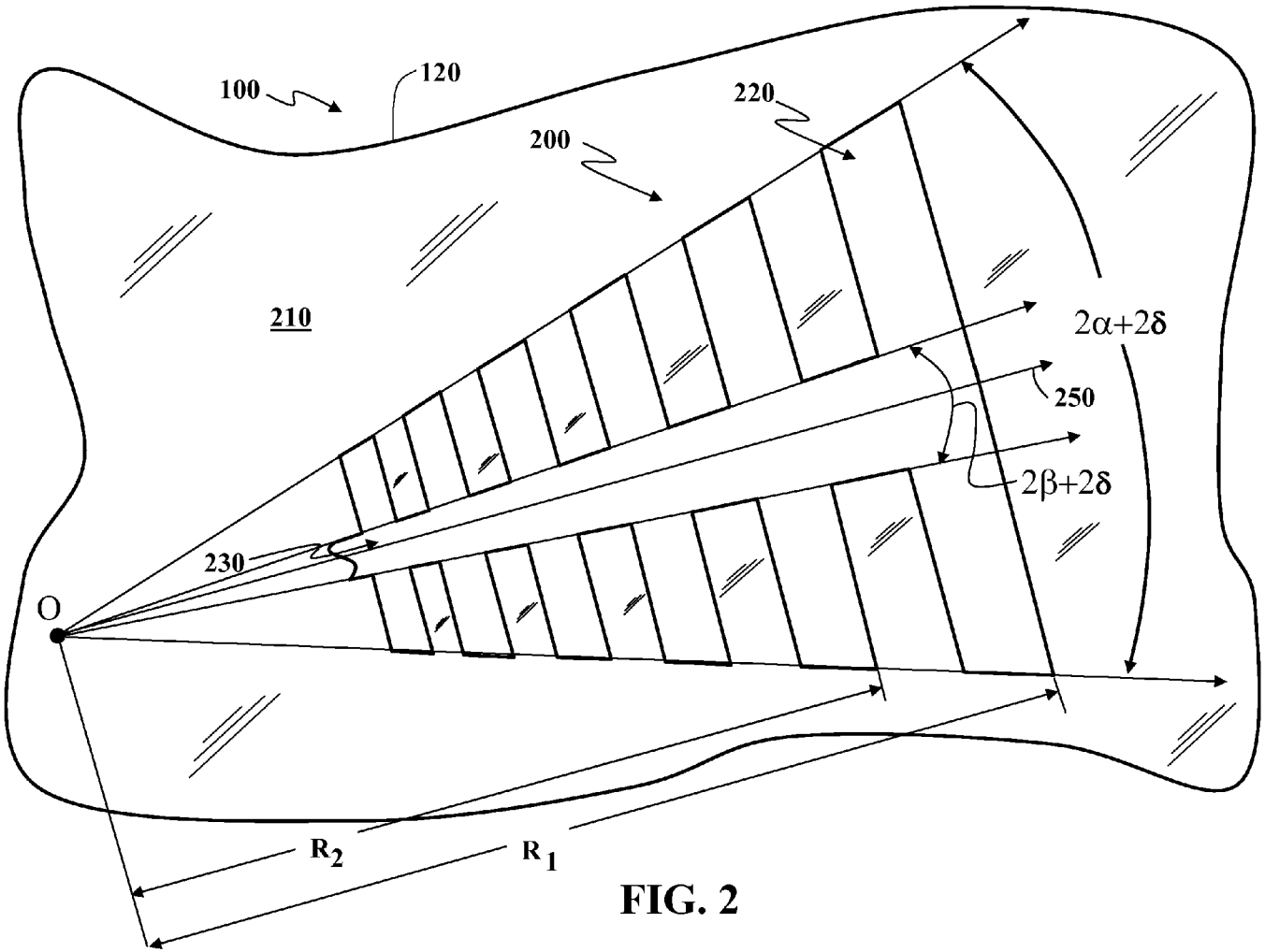
FIG. 2 illustrates in a plan view an example of a ground side of the log-periodic slot array of the present invention.

FIG. 2 illustrates an exemplary ground plane side 210 of the microstrip log-periodic slot array (MLPSA) 100 of the present invention where a slot log-periodic antenna portion 200 may be typically formed from a metallic ground plane which may be applied as the bottom or second surface, of an interposed medium, such as a printed circuit board, and may form the back, bottom or opposite side, of the printed circuit board, i.e., opposite the feed side where the microstrip portion 105 of the MLSPA 100 is affixed. A feeder transmission line portion of the array is within the region that may be shown as subtended by the angle $2\beta$ plus twice a planar slot width w, shown as a small angle $\delta$, and typically a distance perpendicular to a local perimeter w (not shown in FIG. 2). The slot width is typically adjusted in the matching of the impedance of the array of elements, both the microstrip elements and the slot elements of the ground plane, and including the interposed printed circuit board or other mounting media. Typically, the log-periodic array of the present invention is substantially symmetric in plane about a principal axis 250 where the slot dipole elements traverse a slot transmission line 230 and extend as trapezoids bounded by the angle $2\alpha$ plus twice the slot width w, represented as a small angle $2\delta$ as above.

For purposes of illustrating the slot portions of the slot log-periodic antenna portion 200, the elements of the array are numbered starting with the slot dipole element of largest wavelength 220, that is, the element having the exemplary largest transverse span. The maximal radial distance from the reference origin O for the first dipole may be represented as $R_1$. The maximal radial distance from the reference origin O for the second dipole may be represented as $R_2$. The minimal distance from the reference origin O for the first dipole may be represented as $r_1$ less the impedance slot width. A similar relationship may be made for radial distances $R_2$ and $r_2$. Typically, the feeder transmission line angle of the microstrip, or top portion is smaller than the angle of $2\beta$ plus the angle increment (e.g., 2β), required for impedance slot width of the ground side of the dielectric medium, and likewise the angle 2α bottom plus the angle increments 2β of the ground side required for impedance slot width is greater than 2α of the top side. Rather than expressed by the angle δ, this may be expressed as the linear distance w when viewing the planar projections of the microstrip dipole elements and the slot dipole elements in plan view.

Figure 3A:
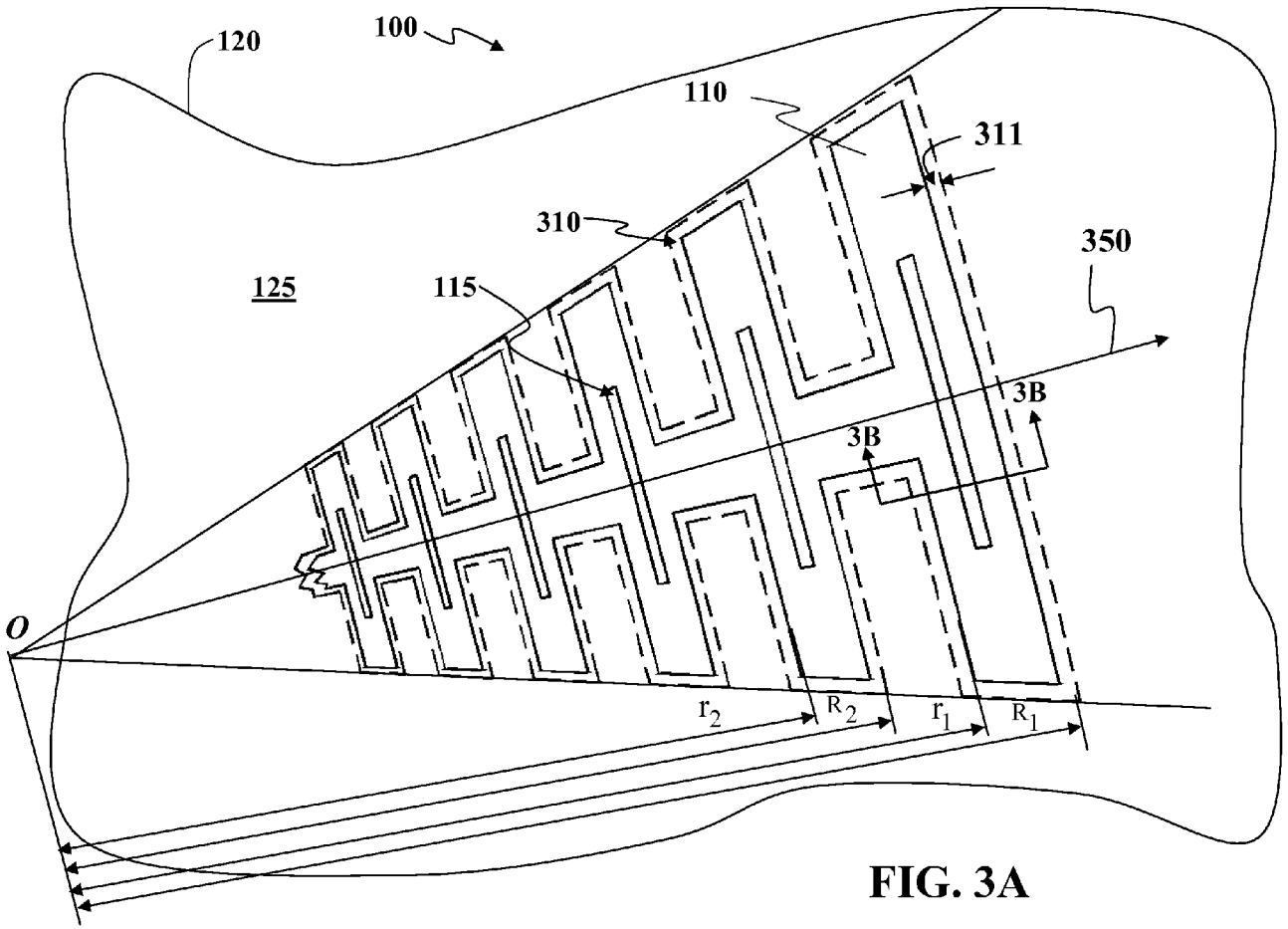
FIG. 3A illustrates in a plan view an example of six elements in an example array of a microstrip log-periodic feed side of the slot array aligned with a log-periodic ground side of the slot array.
Figure 3B:
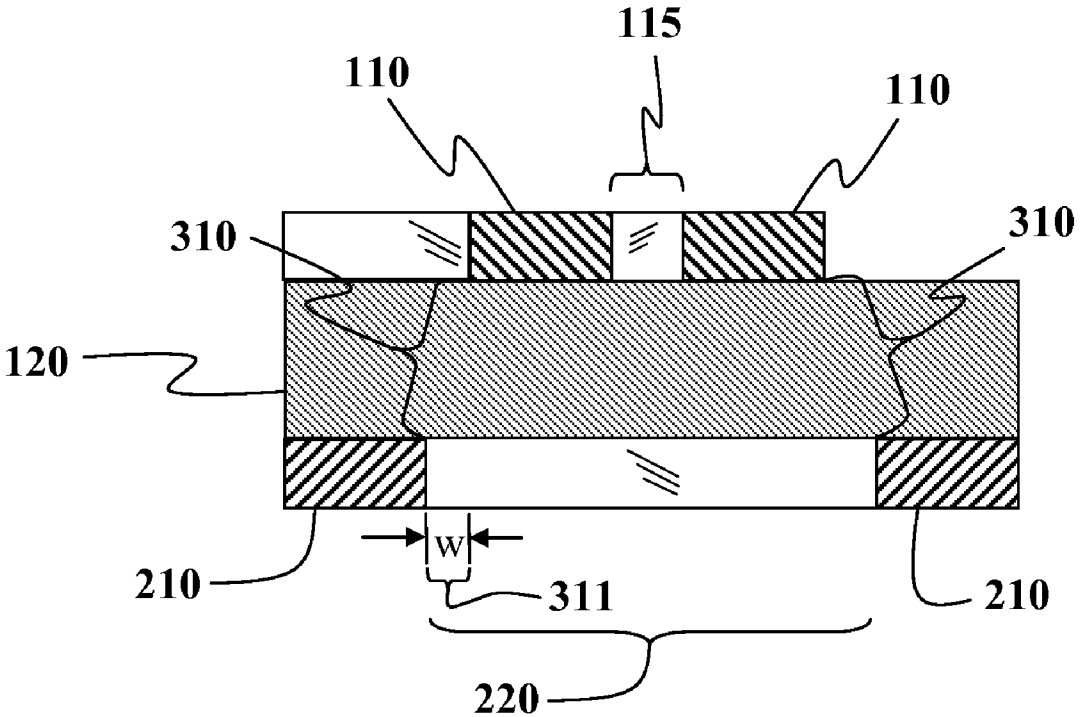
FIG. 3B illustrates in a cross-sectional view an example of an element in the example array of the microstrip log-periodic feed side of the slot array aligned with the log-periodic ground side of the slot array.

For each exemplary pair of top and bottom trapezoidal dipole elements, an impedance slot may be created as shown in the top view of the antenna of FIG. 3A, where FIG. 3A illustrates in a top view an exemplary array of the MSLPA showing six element pairs and where the impedance slot is shown in the space 310 between the microstrip and the ground plane having, in a projection made substantially perpendicular to the local surface and through the interposed dielectric media 120, the slot width 311, w. In this exemplary array of the MSLPA, the top and bottom sides are overlaid, where the dashed lines indicate the boundary or slot perimeter of the ground-side present on the bottom side of the dielectric medium. Accordingly, in an exemplary embodiment, the MSLPA is affixed to the dielectric medium, such as a printed circuit board (PCB), in an orientation such that the edges of the ground plane side of the slots of the MLPSA generally provide for an outer perimeter. Put another way, the perimeter of the slot portion is oversized relative to the perimeter of the microstrip portion and the perimeter of the microstrip portion is undersized relative to the slot portion. FIG. 3B illustrates in cross-sectional view the microstrip portion 110 of an element in relation to a ground plane portion 210 and an interposed PCB, as an example of a dielectric medium 120. In this view (FIG. 3B), an internal centered slot 115 may be seen in cross-section as well as a slot element 220 of the MLPSA. Also illustrated in cross-sectional view of FIG. 3B, an impedance slot is shown in the space 310 between the microstrip and the ground plane having, in a planar projection, the slot width 311, w. The resulting stacked MSLPA is operable to function as a substantially frequency-independent antenna having a traversing of its center with respect to frequency substantially along a line of bilateral symmetry 350 (FIG. 3A).

Another antenna embodiment is described as follows where w represents the planar width of the impedance slot, τ represents the element expansion ratio, and ∈ represents a measure of tooth width in the following equations:

$$\tau = \frac{R_{n+1}}{R_n} = \frac{r_{n+1}}{r_n} \quad [1]$$

and $$\varepsilon = \frac{r_n}{R_n}. \quad [2]$$

An "over angle" subtended by the completed antenna may be represented 2α+2δ. Exemplary relationships include an ∈ of $\sqrt{\tau}$, a β of $\alpha_{SL}/3$, and an $\alpha_{SL}$ Of (α+δ)/2.

Exemplary antenna array properties include a value for the over angle, or 2α+2δ of approximately 36 degrees, a value for 2α of approximately 33 degrees, a value for $2\alpha_{SL}$ of approximately 18 degrees, and a value for 2β of approximately 6 degrees.

Exemplary antenna array properties are illustrated in Table 1 with distances in inches for dipole teeth numbered 1-19:

TABLE 1

Exemplary Antenna Properties

| R | r | τ | ϵ | w | # |
|---|---|---|---|---|---|
| 5.500 | 4.980 | 0.82 | 0.91 | 0.0866 | 1 |
| 4.510 | 4.084 | 0.82 | 0.91 | 0.0710 | 2 |
| 3.698 | 3.349 | 0.82 | 0.91 | 0.0582 | 3 |
| 3.033 | 2.746 | 0.82 | 0.91 | 0.0477 | 4 |
| 2.487 | 2.252 | 0.82 | 0.91 | 0.0391 | 5 |
| 2.039 | 1.846 | 0.82 | 0.91 | 0.0321 | 6 |
| 1.672 | 1.514 | 0.82 | 0.91 | 0.0263 | 7 |
| 1.371 | 1.242 | 0.82 | 0.91 | 0.0216 | 8 |
| 1.124 | 1.018 | 0.82 | 0.91 | 0.0177 | 9 |
| 0.922 | 0.835 | 0.82 | 0.91 | 0.0145 | 10 |
| 0.756 | 0.685 | 0.82 | 0.91 | 0.0119 | 11 |
| 0.620 | 0.561 | 0.82 | 0.91 | 0.0098 | 12 |
| 0.508 | 0.460 | 0.82 | 0.91 | 0.0080 | 13 |
| 0.417 | 0.377 | 0.82 | 0.91 | 0.0066 | 14 |
| 0.342 | 0.310 | 0.82 | 0.91 | 0.0065 | 15 |
| 0.280 | 0.254 | 0.82 | 0.91 | 0.0053 | 16 |
| 0.230 | 0.202 | 0.77 | 0.88 | 0.0047 | 17 |
| 0.177 | 0.155 | 0.77 | 0.88 | 0.0036 | 18 |
| 0.136 | 0.120 | 0.77 | 0.88 | 0.0028 | 19 |

The present invention, in its several embodiments, typically has the antenna structurally divided into two portions on either side of a mounting medium, such as a two-sided PCB. The two-sided printed circuit board embodiment accommodates an exemplary feed described below. That is, a feed transition from a microstrip to radiating elements may be fabricated with a dielectric medium, such as a two-sided printed circuit board and a tapered ground. In addition to the various feed embodiments, the two-sided PCB structure and material provide additional means by which the antenna impedance of the several antenna embodiments may be controlled, for example, by variation of material thickness and by selection of a dielectric constant of the PCB. Due to a field constraint within the dielectric material, high power, high frequency alternative embodiments of the present invention may exploit the increased breakdown characteristics of the higher frequency, i.e., the smaller wavelength, portion of the antennas.

Figure 4:
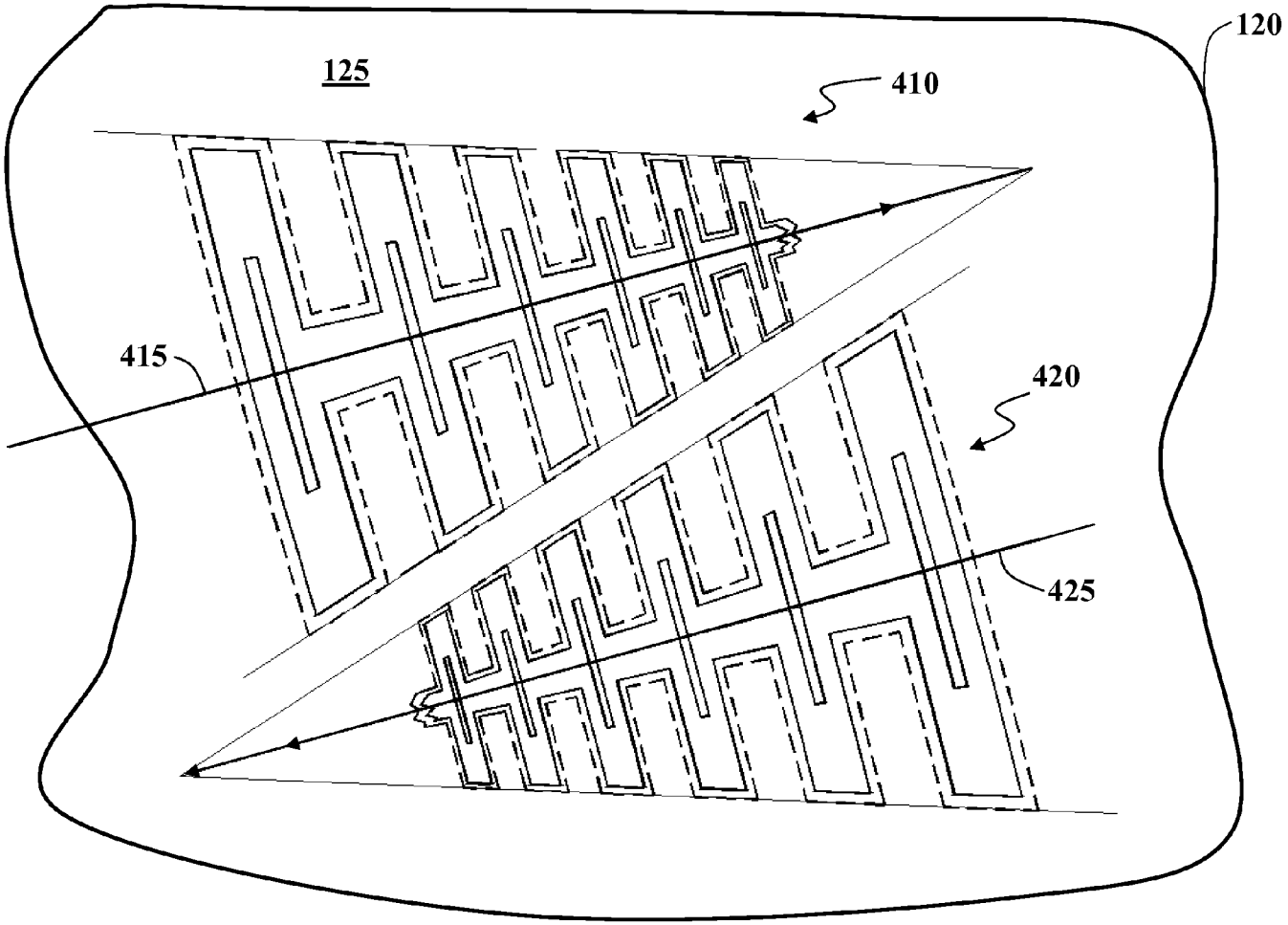
FIG. 4 illustrates in a plan view an exemplary, typical placement of two antenna elements of the present invention proximate to one another and oriented so that each has a traveling phase center verses frequency opposite the other.

FIG. 4 illustrates an exemplary placement of two microstrip, log-periodic arrays of an embodiment of the present invention that are proximate to one another and oriented so that a phase center 415 of a first antenna 410 is substantially opposite a phase center 425 of a second antenna 420 and may receive or transmit substantially as a single combined antenna element. These opposing phase centers are typically offset, which may adapt these combined elements to the direction finding of targets out of the plane of the elements; that is, receiving RF energy at angles of arrival substantially off the axes of the opposing phase centers 415 and 425.

Figure 5A:
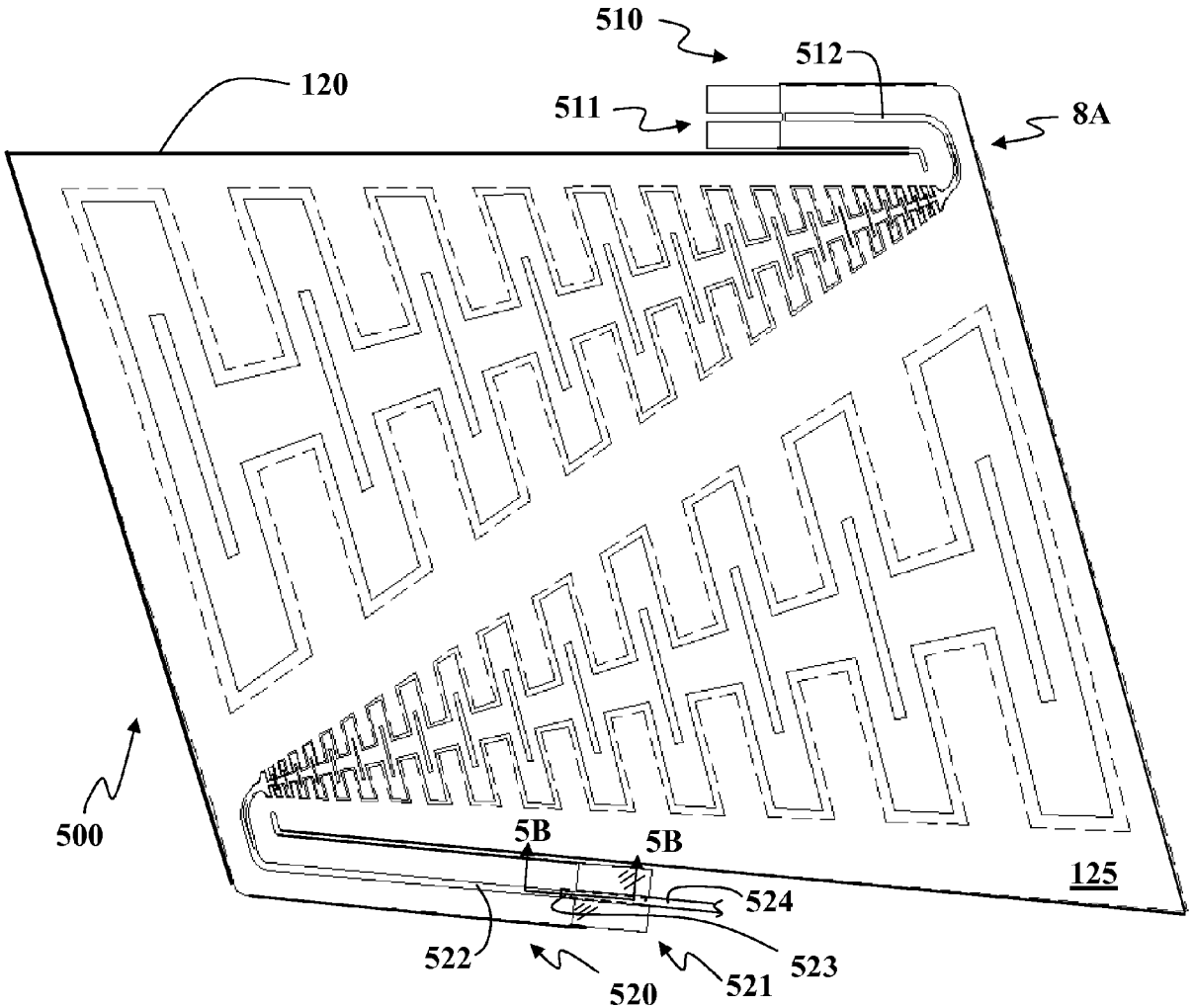
FIG. 5A illustrates in a plan view an exemplary, typical embodiment where a printed circuit board has two microstrip log-periodic array feeds on a top side and their corresponding aligned ground planes on an opposite side of the printed circuit board.
Figure 5B:
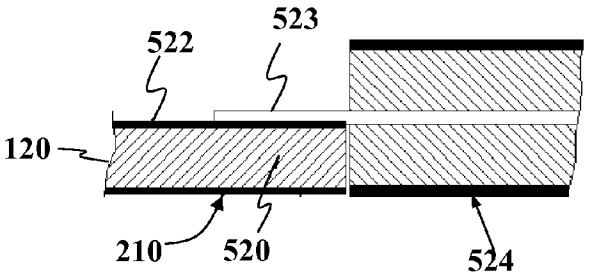
FIG. 5B illustrates in a cross-sectional view a fork region of a tongue of an embodiment engaging a coax inner wire.

FIG. 5A illustrates an exemplary embodiment 500 where a PCB has two MSLPAs with feeds on an illustrated upper surface, or top side, and corresponding aligned ground planes on an opposite surface, or bottom side, of the PCB where each form an antenna and together form an antenna array on the PCB. FIG. 5A illustrates exemplary feed tongues 510 and a second feed tongue 520, i.e., one for each antenna. For example, an inner wire or conductor 523 of a coaxial feed line, once within a fork 511 or 521 of each feed tongue, may be soldered or otherwise put in electrical connectivity with a microstrip feed line 512, 522 and soldered or otherwise put in electrical connectivity with the ground plane. As illustrated by FIG. 5B, a cross-sectional view of FIG. 5A at the second feed tongue 520, typically, an outer conductor 524 of a coaxial conductor may also have direct current (DC) connectivity with the ground plane 210, which is shown by example as being on the bottom side of the PCB 120, and the inner wire 523 also typically has connectivity with the microstrip feed line 522 which is shown by example as being on the top side of the PCB 120. Further detail of the planar projection of the perimeter of an exemplary curvilinear portion of the microstrip feed line relative to the planar projection of the perimeter of an exemplary curvilinear, tapered ground transition is described below and illustrated in FIG. 8A.

Mounting

Figure 6:
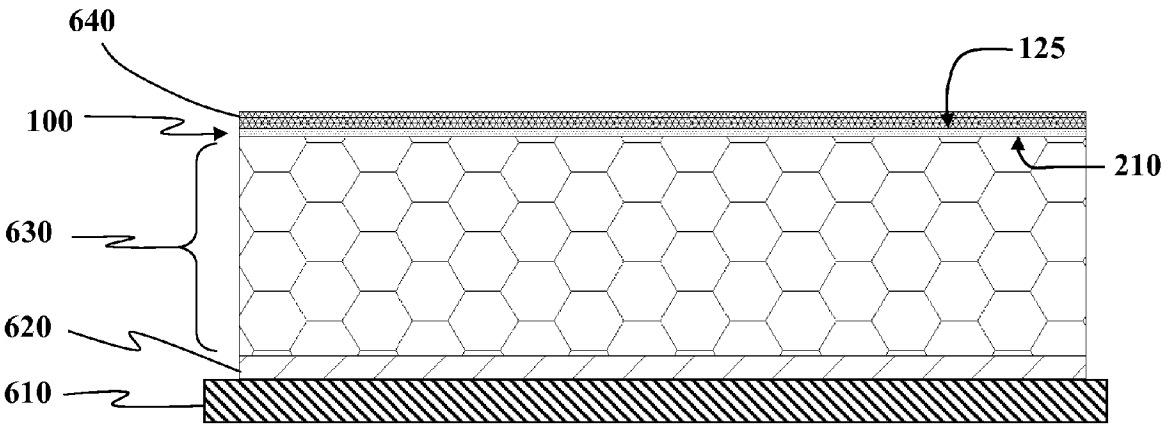
FIG. 6 illustrates in a cross-sectional view of an exemplary mounting.

The antenna array elements of the several embodiments may be mounted above a grounded cavity, or other receiving element, which provides both grounding and feed lines such as the coaxial conductor example described above. Illustrated in FIG. 6 is an exemplary cavity having a bottom surface 610 that may be formed of metal, e.g., steel, titanium, aluminum or various metal alloys, where a radio frequency absorber element 620, or sheet, may be interposed between the cavity surface and the bottom side such as the ground plane 210 of the antenna array elements. In addition, a low dielectric material deployed as foam or a honeycomb-type element 630 that may be interposed between the radio frequency absorber element 620 and the bottom side 210 of the antenna array elements.

The antenna array element 100, the radio frequency absorber element 620, and a low dielectric element may be bonded together. For environmentally challenging environments, such as for example those encountered in moisture laden atmosphere with high dynamic pressures experienced at supersonic velocities, a cover 640, skin, or radome may be used to shield, or protect, or otherwise cover all or a portion of the top surface 125 or outwardly directed portion of the antenna array element, a covered portion that may include the top side 125 of the dielectric medium 120, thereby covering a region that could or would otherwise be in direct environmental contact with free space, for example. The microstrip line array of the top side 125 and the ground plane slots of the bottom side of the array may be fabricated on a low loss, low dielectric substrate, e.g., RT5880 DUROID®, a substrate available from Rogers Corporation, Advanced Circuit Materials Division, of Chandler, Ariz., or may be fabricated of equivalently low dielectric materials at thickness of around 15 mils, for example. Other thickness ranges may be used depending on the properties of the low dielectric material and a desired gap 310 (FIG. 3B). In addition, a cavity resonance absorber, such as a flexible, ferrite-loaded, electrically non-conductive silicone sheet may be applied within a cavity mounting. Where the cavity is formed of metal or has a metalized or electrically conductive surface, the antenna array may be in electrical contact with the cavity surface where the cavity surface may serve as the base ground plane of the antenna array. In addition, the two-sided PCB embodiments of the array may provide the ability to control, by selection, the impedance by selecting from variations of PCB material thickness and their respective dielectric constants.

The substantially planar profile of the antenna array may exhibit some curvature and, whether flat or contoured, may be conformally mounted. In those geometries requiring conformal mounting about a radius of curvature, the transverse edges of the otherwise typically trapezoidal dipole elements are themselves typically curved to accommodate a curved printed circuit board surface that may then conform to a selected mounting geometry.

The several embodiments of the invention have gain and pattern properties, which are typically robust with respect to an effect of cavity depth on the elements. For example, a cavity with an absorber-lined bottom surface and metal back negligibly affects on the antenna gain and pattern properties where cavity depth is at a minimum of 0.1 lambda, i.e., one-tenth of a wavelength of the frequency in question. Put another way, the exemplary embodiments may be configured to experience a slight loss of antenna gain or antenna gain-angle pattern distortion for cavities shorter than one-tenth lambda with a corresponding change in the input voltage standing wave ratio (VSWR).

Microstrip Feed Structure

Some high power, high frequency applications of the several embodiments may experience an increase in the breakdown characteristics of the high frequency portion of the elements. Exemplary feed structure embodiments readily accommodate elements operating from frequencies below X-band through well into the Ka-band. In order to accommodate structures into the upper Ka-band, micro-etching techniques are typically applied. At these higher frequencies, material thicknesses are typically reduced from those accommodating X-band antenna embodiments.

Figure 7:
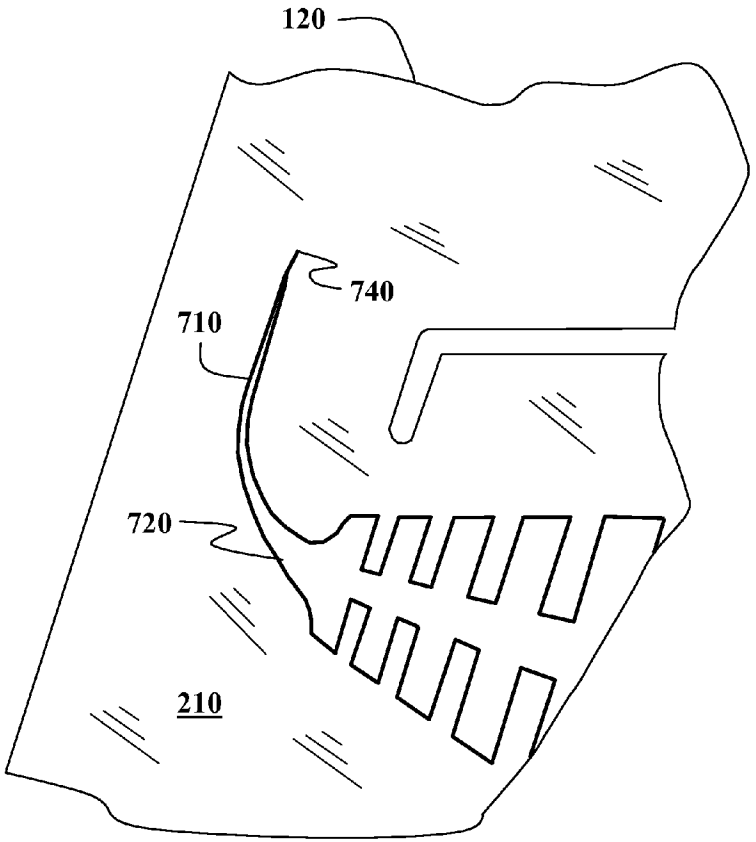
FIG. 7 illustrates in a plan view of an exemplary curved taper in the grounded side of the exemplary microstrip log-periodic array from the last element to the ground plane.

Each of the antenna array elements typically includes a microstrip feed structure that splits and feeds to the two-sided antenna array element. Some embodiments of the feed structure combine microstrip feed lines with a tapered ground transition and the two-sided antenna element. Typically the feed structure includes a microstrip feed line having a tapered ground transition. FIG. 7 illustrates an exemplary curvilinear, tapered ground transition 710 from the last element (e.g., a high or highest frequency element) of the MSLPA. A transition from the last slot element 720 to a feed transmission line is tapered in this exemplary fashion in part to minimize VSWR effects and to continue the transition from microstrip to the antenna element. The feed transmission line is tapered in this exemplary embodiment to a point 740. In addition, a base of a slot feed transmission line taper may curve in a direction of the exemplary feed-line tongue 510, 520 (not depicted) to minimize sharp angles that may otherwise set up what may be undesired or parasitic active portions.

Figure 8B:
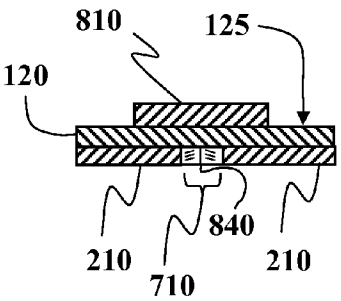
FIG. 8B illustrates in cross-sectional view of an exemplary microstrip feed line as it curves from the feed-line tongue to the base of the exemplary microstrip log-periodic array.
Figure 8A:
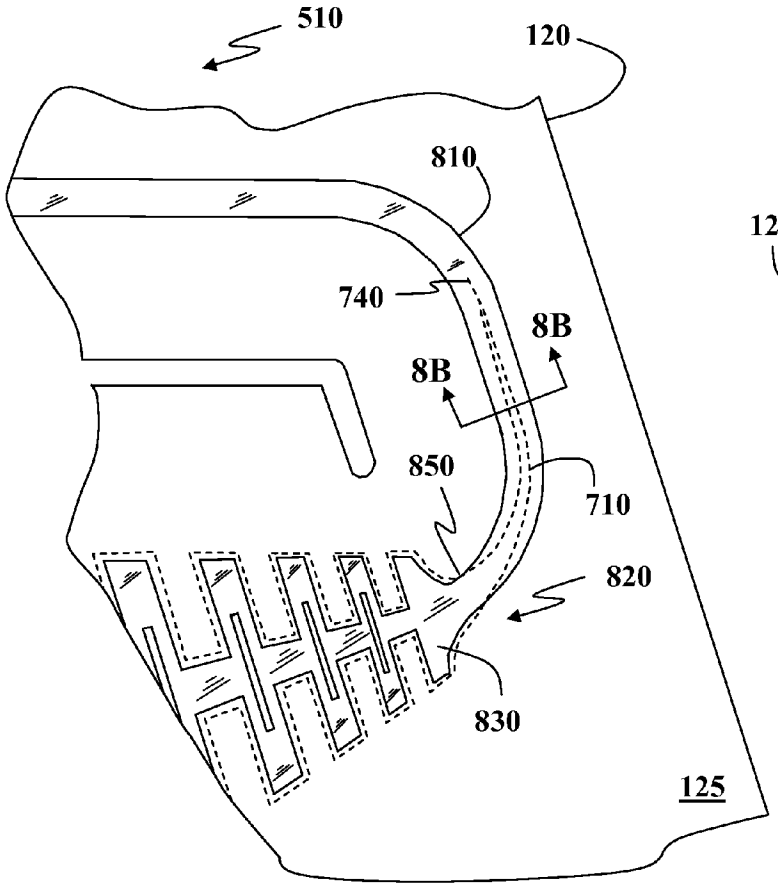
FIG. 8A illustrates in plan view of an exemplary microstrip feed line as it curves from the feed-line tongue to the base of the exemplary microstrip log-periodic array.

FIG. 8A illustrates an exemplary microstrip feed line 810 as it curves from the feed line tongue 510 (see FIG. 5A) to the base of the MSLPA 820 where the feed line 810 flares out to a last element of the MSLPA. A last element 830 of the MSLPA is tapered, in this example, in part to minimize feed point radiation and prevent the last element from arraying with the proximate element to form a radiating beam for this section and accordingly improve input matching over base elements lacking a tapered feed line. The tapering, or decreasing width, of the transition from the last slot element 720 to the slot feed transmission line 710 may cause the slot width or perimeter of the slot feed transmission line, in a planar projection made perpendicular or substantially perpendicular to the surface or local surface regions of the dielectric medium 120 to which the slotted ground plane 210 is attached, to fall within, as depicted at 850, the plan form of the exemplary microstrip feed line 810 that is to be within a projection of the perimeter of the microstrip feed line 810 made perpendicular to the surface or local surface regions of the dielectric medium 120 to which the microstrip feed line 810 is attached. The last element in these exemplary embodiments typically does not have a parasitic slot within its perimeter. Also shown in this view is the relative orientation of the exemplary microstrip feed line 810 and the curvilinear, tapered ground transition 710 along with its exemplary tip ending 740 that, in a planar projection made planar to the local surface, is within the plan form, or perimeter, of the exemplary microstrip feed line 810; that is, within a projection of the exemplary microstrip feed line 810 made perpendicular to the local surface. Accordingly, when viewed in plan view and projecting across the interposed dielectric medium 120, the antenna embodiments may have a curvilinear, electrically conductive microstrip feed line 810 and a substantially co-extensive curvilinear slot transmission line 710 for a portion of the run of the microstrip feed line 810. FIG. 8B illustrates in cross-sectional view, the exemplary microstrip feed line 810 as it curves from the feed line tongue 510 to the base 820 of the MSLPA where the feed line flares out to the last element 830 of the MSLPA. Also illustrated in this view is the tapered ground transition 710 ending at the tip corner 840.

Receiving, Transmitting and Transceiving

Figure 9:
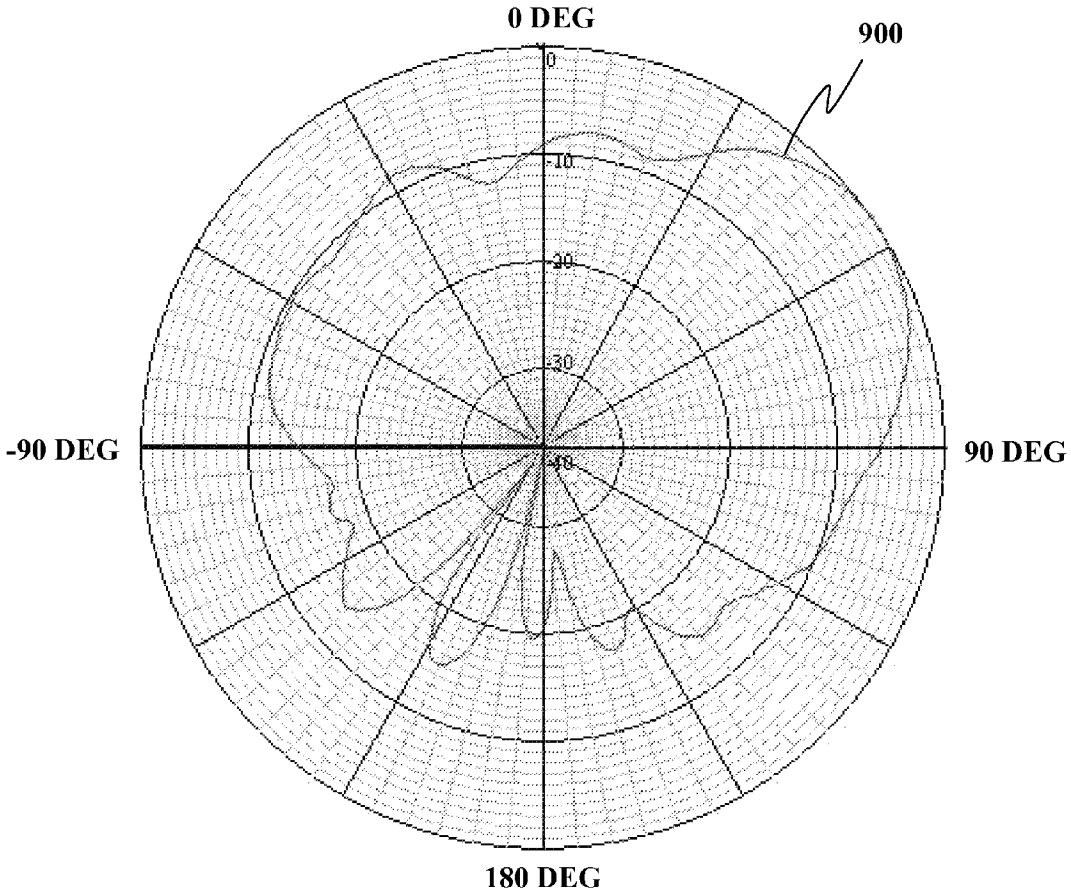
FIG. 9 illustrates an exemplary antenna gain pattern produced from measurements of an exemplary antenna taken at a low frequency.
Figure 10:
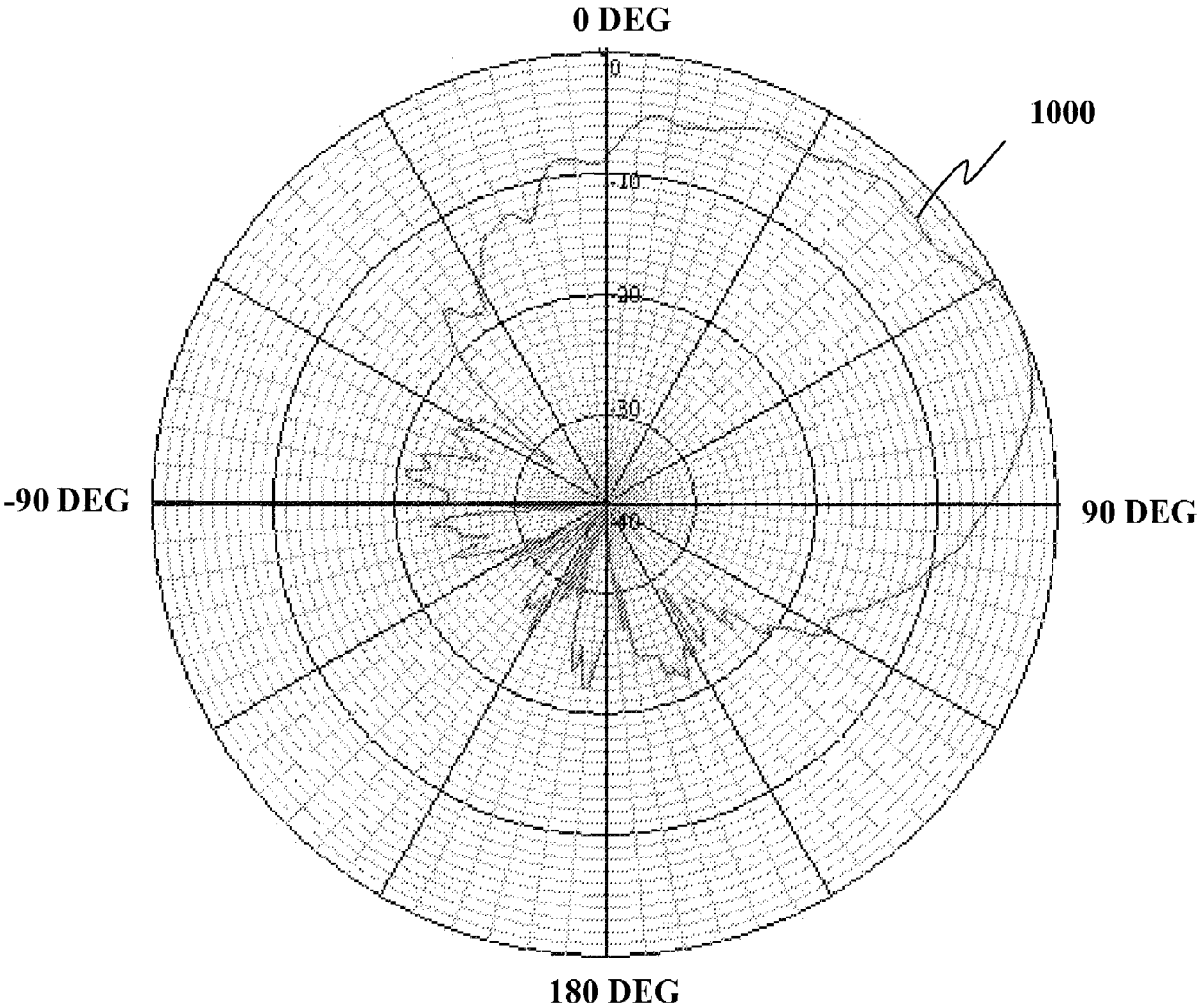
FIG. 10 illustrates an exemplary antenna gain pattern produced from measurements taken at a midrange frequency.

The antenna array embodiments of the present invention may provide substantially constant forward directivity, typically with only subtle or otherwise operationally negligible changes in beam-width, and afford an antenna array of forward and aft facing elements of equal or nearly equal performance. For purposes of illustrating the performance of an embodiment of the present invention, the antenna array of forward-oriented and aft-oriented element arrays where the MSLPAs have fifteen trapezoidal dipole elements, i.e., teeth, and one base tapered trapezoidal dipole element were tested. FIG. 9 illustrates an antenna gain pattern 900, in dB, as a function of beam angle pattern produced from measurements taken at a low frequency, i.e., directed radio frequencies intended to excite the larger dipole elements. FIG. 10 illustrates an antenna gain pattern 1000, in dB, as a function of beam angle produced from measurements taken at a midrange frequency, i.e., directed radio frequencies intended to excite the intermediate-sized dipole elements.

The antenna pairs 500 (FIG. 5A) may be mounted, as arrays of pairs, to surfaces that may include surfaces integral to vehicles, such as air vehicles and surface portions of sensor pods that may be deployed on vehicles such, as air vehicles.

The antenna element embodiments are suitable for conformal mounting, for example, structures shaped principally for low drag properties such as those shapes found in air vehicles and land and marine vehicles having application sensitive to dynamic pressure conditions and disruptions of laminar flow patterns. Accordingly, an exemplary mounting site for one or more antenna elements may be a portion of a rocket or missile. The cylindrical shape of the body would allow for a circumferential array of elements of fore and aft configuration. With excellent low angle pattern coverage the system could achieve near full hemispheric coverage. Such a system can provide direction finding (DF) and angle-of-arrival (AOA) input signals. For some broad side angles it also provides additional benefit in AOA and DF in that there are twice as many elements with opposing phase directions that have a view of the incoming signal. A single forward looking set may be implemented for a forward-only array for DF/AOA applications. A single forward looking set would simply have limited the total field of view compared with a forward and rear-looking embodiment.

The antenna elements may be electrically connected to a radio frequency receiver system or a radio frequency transmitting and receiving system which may be termed a transceiver. An RF receiver may process the electric current from the antennas via a low noise amplifier (LNA) and may then down convert the frequency of the waveform via a local oscillator and mixer and may process the resulting intermediate frequency waveform via an adaptive gain control amplifier circuit. The resulting conditioned waveform may be sampled via an analog-to-digital converter (ADC) with the discrete waveform being processed via a digital signal processing module. Where the frequency of the RF waveform is well within the sampling frequency of the conversion rate of the ADC, direct conversion may be employed and the discrete waveform may be processed at a rate comparable to the ADC rate. Receivers may further include signal processing and/or control logic via digital processing modules having a microprocessor, addressable memory, and machine executable instructions. An RF transmitter may process digital waveforms that have been converted to analog waveforms via a digital-to-analog converter (DAC) and may up-convert the analog waveform via an in-phase/quadrature (I/Q) modulator and/or step up the waveform frequency via a local oscillator and mixer, then amplify the up-converted waveform via a high-power amplifier (HPA) and conduct the amplified waveform as electric current to the antenna. Transmitters may further include signal processing and/or control logic via digital processing modules having a microprocessor, addressable memory, and machine executable instructions. Transceivers generally have the functionality of both a receiver and a transmitter, typically share a component or an analog or digital signal processing module, and employ signal processing and/or control logic via digital processing modules having a microprocessor, addressable memory, and machine executable instructions.

Figure 11A:
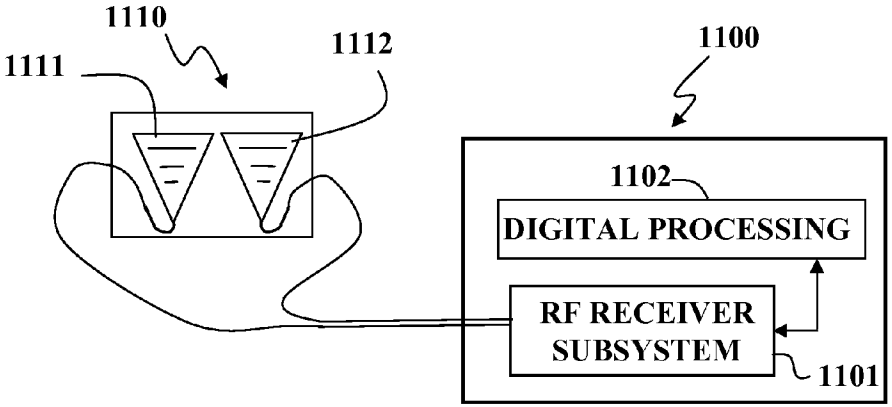
FIG. 11A illustrates an exemplary receiver system operably connected to exemplary antenna element embodiments of the present invention.
Figure 11B:
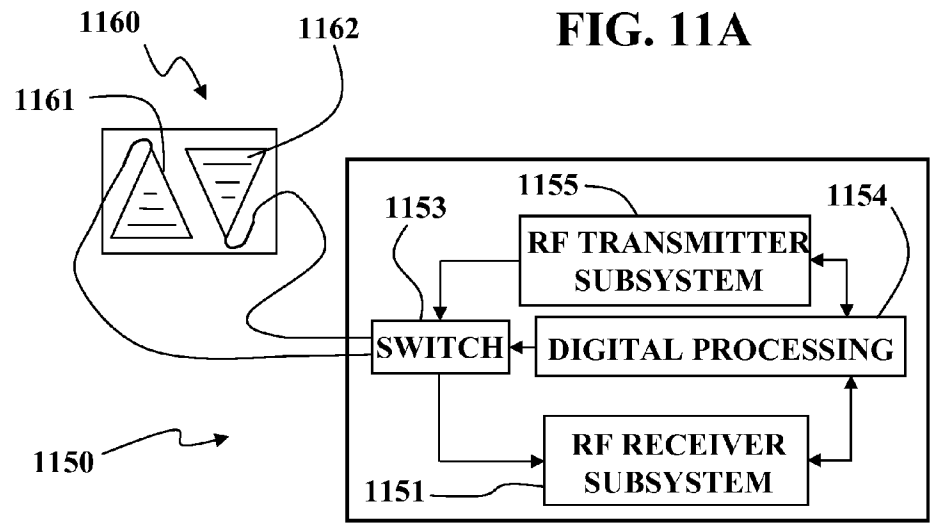
FIG. 11B illustrates an exemplary transceiver system operably connected to exemplary antenna element embodiments of the present invention.

FIG. 11A illustrates in a functional block diagram that as part of a receiver system 1100, the RF energy sensed by the exemplary antenna elements 1111, 1112 of an antenna array 1110 may be processed within a receiver subsystem 1101 via switches, low noise amplifiers, bandpass filters and/or other signal conditioning processes and filters and may be stepped down, i.e., down converted, in frequency for further processing by the digital signal processing 1102 of the receiver and associated digital signal processing. FIG. 11B illustrates in a functional block diagram that as part of a transceiver system 1150 having an RF receiving, or receiver, subsystem 1151 and an RF transmitting, or transceiver, subsystem 1155, the exemplary antenna elements 1161, 1162 of an antenna array 1160 may be energized, via one or more properly thrown switches 1153 to transmit signals initiated by the digital signal processing 1154 and conditioned by a transmitting subsystem 1155 and, when not transmitting, the exemplary antenna elements 1161, 1162 may function as passive elements to sense incoming RF energy that this is conducted, again via one or more properly thrown switches 1153 to the RF receiver system 1151. An RF transmitting system, whether a transceiver subsystem or a separate transmitter system, functions separately at the front-end (i.e., proximate to the antennas) from the receiver and so the transmitter antennas and receiver antennas may be physically different antennas or time-shared via switches. Accordingly, references to an RF transmitter refer generally to the transmitting functionality whether embodied as a stand-alone transmitter or a transmitter subsystem of a transceiver. Likewise, references to an RF receiver refer generally to the receiving functionality whether embodied as a stand-alone receiver or a receiver subsystem of a transceiver.

Figure 12:
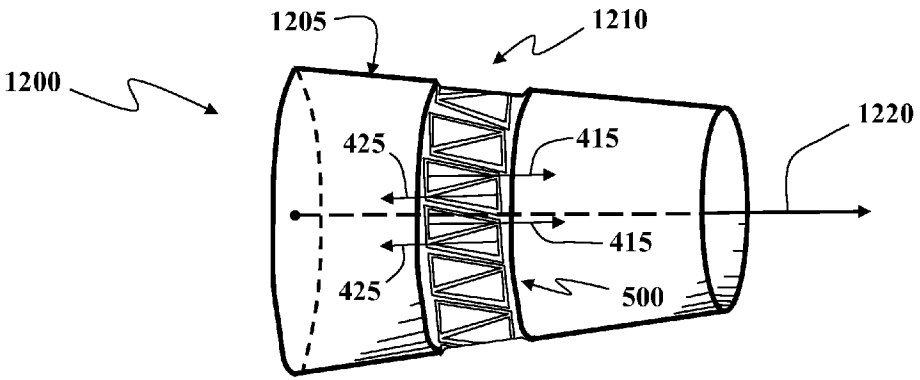
FIG. 12 illustrates an exemplary conformal antenna array disposed about a support structure.

FIG. 12 illustrates an array of antenna pairs 1210, where each pair 500 has an alternating forward-directed phase center 415 and aft-directed phase center 425, and each pair 500 is disposed substantially equidistantly about a centerline 1220 of a mounting structure 1200, itself having a surface 1205 that may form a portion of the fuselage or other surface of an air vehicle.

Figure 13:
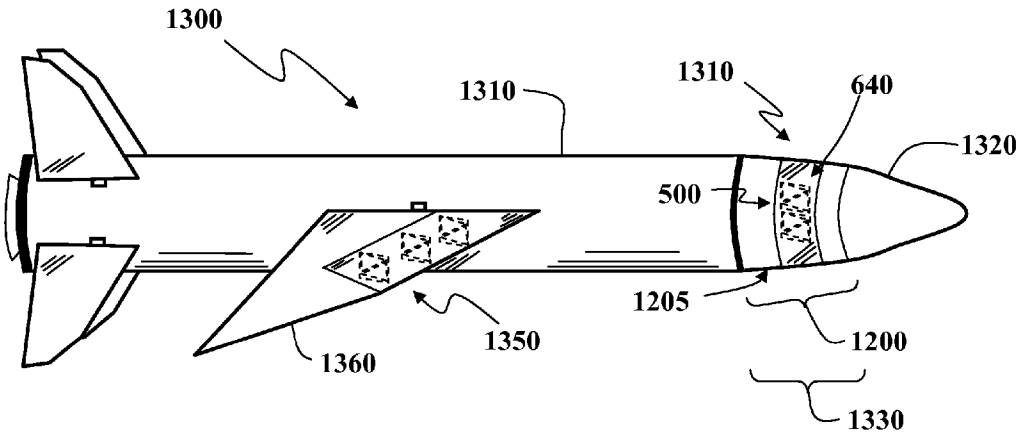
FIG. 13 illustrates an exemplary conformal antenna array mounted to portions of an air vehicle.

While cylindrical or round embodiments of an array of antenna elements or pairs of elements have been shown in the example of an air vehicle fuselage, these elements, of one or various scales, may be applied to oval, rectangular and multisided structures, such as hexagons and octagons. Antenna elements, of one or various scales, may also be embedded into surfaces of wings along an axis rather than or in addition to an array disposed circumferentially about the fuselage. Multiple elements can be separated by a wing or fuselage, exemplified by separation on the top and bottom of a wing or on the left and right wings, or on the vertical fins of an aircraft or missile. FIG. 13 illustrates the mounting structure 1200 placed at a forward end of a fuselage 1310 and, in this example, placed aft of a nose cone or radome 1320. The mounting structure has an array of antenna pairs 1110, placed at a front end of an exemplary air vehicle 1300 which may then cooperatively function as a mobile receiving or transmitting apparatus. The array of antenna pairs 1210 is typically covered by a protective covering 640 when the mounting structure is placed in proximity to the front end of the air vehicle 1300. The front end portion of the fuselage 1310 having an MSLPA 100 (FIG. 3A), an antenna pair 500, or an array of antenna pairs 1210 may comprise a guidance section 1330 of the air vehicle 1300. The guidance section 1330 may further include the nose cone or radome 1320. Also shown is a linear array of antenna pairs 1350 mounted conformally on a lifting surface 1360 of the air vehicle 1300.

Some antenna embodiments of the present invention may be used to send, receive or transceiver RF signals. Accordingly, an array of at least a pair of substantially frequency independent planar antenna array elements may function as a receiving array and may alternatively function as a transmitting array or a transmitting and receiving, that is, the array may function as a transceiver array.

Scaled Embodiments

Because of the feed structure, the bandwidth capabilities are extremely broad. A scaled version of the prototype antenna was created at one-seventh (1/7) of the original size. Properties of an exemplary antenna scaled from the example antenna of Table 1 are provided in Table 2 with distances in inches for dipole teeth numbered 1-9:

TABLE 2

Exemplary Antenna Properties

| R | r | τ | ϵ | w | # |
|---|---|---|---|---|---|
| 0.756 | 0.685 | 0.82 | 0.91 | 0.0119 | 1 |
| 0.620 | 0.561 | 0.82 | 0.91 | 0.0098 | 2 |
| 0.508 | 0.460 | 0.82 | 0.91 | 0.0080 | 3 |
| 0.417 | 0.377 | 0.82 | 0.91 | 0.0066 | 4 |
| 0.342 | 0.310 | 0.82 | 0.91 | 0.0065 | 5 |
| 0.280 | 0.254 | 0.82 | 0.91 | 0.0053 | 6 |
| 0.230 | 0.208 | 0.82 | 0.91 | 0.0036 | 7 |
| 0.188 | 0.171 | 0.82 | 0.91 | 0.0030 | 8 |
| 0.155 | 0.140 | 0.82 | 0.91 | 0.0024 | 9 |

Dielectric thickness was also partially scaled down from the antenna element characterized in Table 1, but, due to material limitations, was not fully scaled down. The one-seventh scaled antenna element characterized by Table 2 has only one-quarter (¼), rather than a one-seventh, of the dielectric thickness of the antenna element characterized in Table 1. So, if RT5880 DUROID® is used as a substrate, the scaled thickness of the antenna element characterized in Table 2 is approximately 4 mils. Overall, the scaling resulted in the antenna element characterized in part by Table 2 operating at seven times the frequency of the antenna characterized in part by Table 1, and the scaled antenna element was tested to the frequency limit of the network analyzers supporting the test conditions. The feed structure continued to operate to the analyzer upper limit which is more than double the frequency of the full scale element example of Table 1. Being readily scalable, the various scaled embodiments of the exemplary antenna may be applied to a variety of structures due in part to their functioning at the various scaled sizes.

Figure 14A:
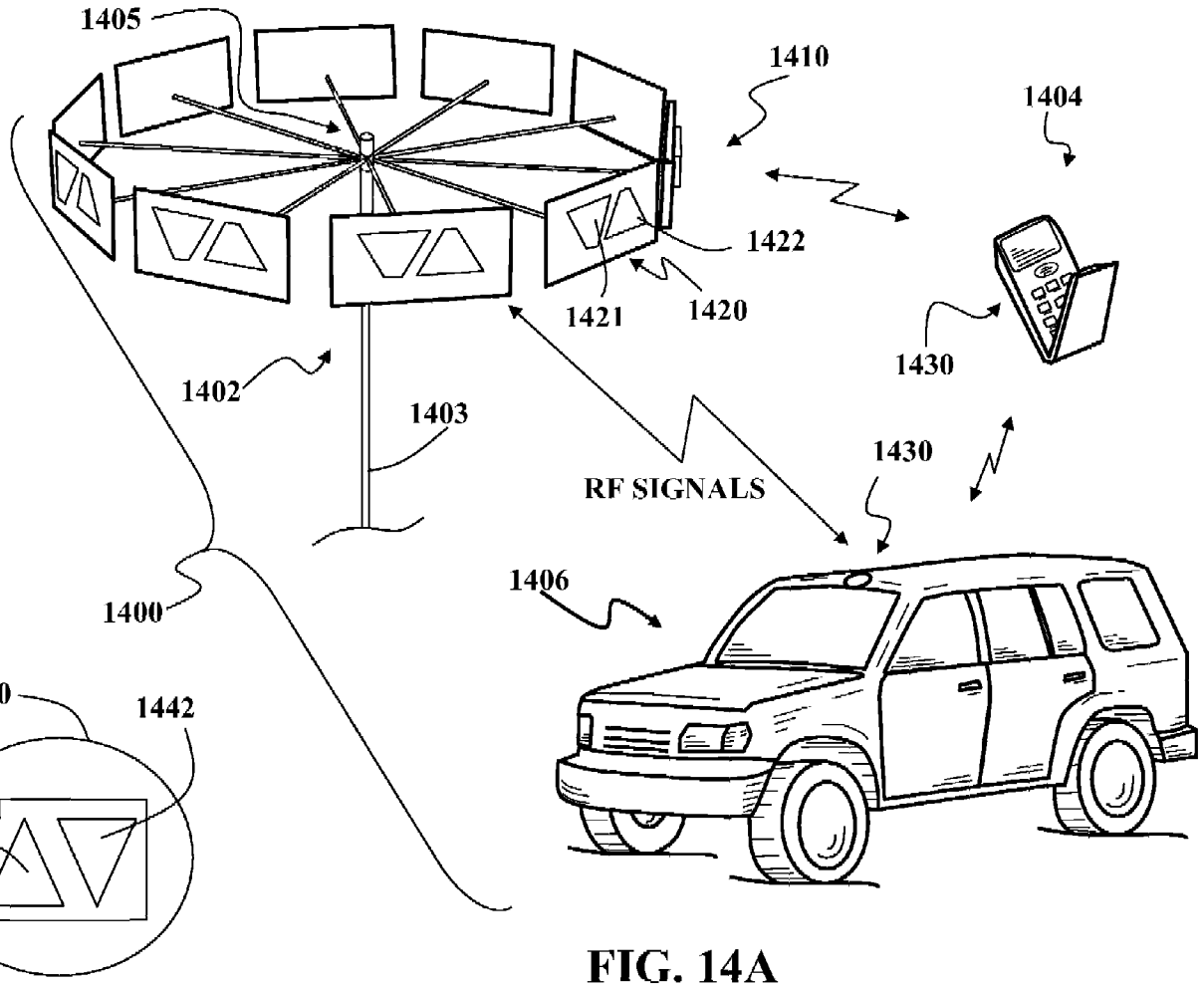
FIG. 14A illustrates an exemplary system where an array of exemplary antenna elements is disposed about a portion of a communications tower and in communication with mobile apparatuses.
Figure 14B:
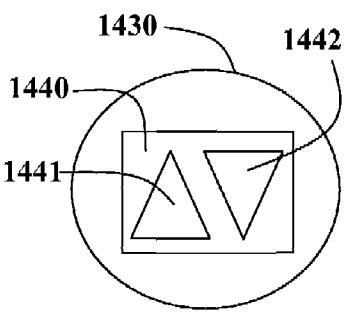
FIG. 14B illustrates an exemplary arrangement of exemplary antenna elements for integrating with the exemplary mobile apparatuses.

In telecommunication applications, the extreme bandwidth and opposing phase travel of pairs of elements support systems such as cellular base stations or point-to-point communication systems. Typical cellular system frequencies range from 800 MHz to 2 GHz in the United States, or as high as 3.4 GHz abroad. This extreme bandwidth provides a diversity antenna system to allow switching to the strongest signal and yet provide attenuation to other towers limiting tower interference and reducing tower traffic. From a mobile unit side, an antenna element, pair of elements, or array of elements or array of elements pairs may be conformally mounted into the top surface of a vehicle such as a car or truck. One antenna could allow for coverage of all cellular systems in a single element. From the tower side, an annular or circular-shaped array may provide DF/AOA tracking of subscribers for system traffic control or to enhance E911 capabilities of the overall system. Exemplary telecommunication embodiments may exhibit particular applicability when considering phones or communication appliances that do not include a GPS tracking capability or where the GPS quality is attenuated due to partial or complete satellite line-of-sight blockage. FIG. 14A illustrates a mobile communication system 1400 comprising a communication tower 1402, a handset 1404 (for example, a human-portable user communication interface), having, for example, one or a pair of conformally embedded exemplary antenna elements 1430 (not shown) and a transceiver, and the system may further comprise a vehicle 1406 also having a pair of exemplary antenna elements 1430 and a transceiver (not shown). The mobile communication system 1400 may further comprise a mobile communications platform functioning similarly to the stationary communications tower 1402 and may further include air vehicles 1300 (see FIG. 13). The handset 1404 may include a human auditory interface for speaking and listening and may include a visual and/or tactile interface for textual and/or graphic communications. The communication tower 1402, as a stationary receiving or transceiving apparatus, comprises an antenna array 1410 of antenna element pairs 1420, that may be disposed at a distal end 1405 of a tower or mast 1403, i.e., above the ground anchor points, where the first antenna element 1421 is electrically oriented in a direction opposite a second element 1422. An antenna element pair site 1430 for the mobile receiving apparatuses may be manufactured into or made substantially conformal with for example a roof portion of a vehicle 1406 or a panel portion of the handset 1404. The handset 1404 is an example of a human-portable interface unit having a transceiver and one or more antenna elements that is in a range of mass portable by a human that includes masses that may be hand-held and masses that may be carried via a backpack or similar conveyance. The exemplary antenna pair site 1430 may include a mounting medium 1440 and at least a first antenna element 1441 and where dimensional applications allow, a second antenna element 1442. In some embodiments, a mobile receiving device 1300 (see FIG. 13), 1404, 1406, or apparatus, may be switched to a mobile transmitting device and its transmissions received by a second mobile receiving device or apparatus.

The configuration of the exemplary embodiments of the antenna element structure allows for adaptation to a variety of media and/or materials. For example, materials for manufacture may range from low cost commercial dielectrics to materials known to endure extreme temperature condition for any and all applications. Low cost commercial materials such as foams or plastics of proper thicknesses, i.e., thickness sufficient to provide the electric separation of portions and the electromagnetic interaction of the portions as provided by the exemplary dielectric of 15 mil and 4 mil thicknesses, may allow for very inexpensive embodiments to be mass produced for commercial hand sets or automotive applications. Midrange materials, such as Rogers 4003, may be used for higher performance, low cost, applications which require little conformity. More flexible materials such as polytetrafluoroethylene (PTFE) circuit materials can be used for high performance mid to high temperature applications such as high speed aircraft which may also require contour matching of the air vehicle skin. Extreme conditions, such as space vehicles or very high speed air vehicles, can take advantage of layered ceramic materials and ceramet or palladium silver, as examples of fired metalized coatings, which can withstand temperatures in excess of 750 degrees Fahrenheit.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims.

We claim:

1. A radio frequency (RF) receiving apparatus comprising:

an RF receiver and a plurality of antenna elements;

wherein a first antenna element of the plurality of antenna elements is a log-periodic antenna element comprising:

a slot log-periodic antenna portion in proximity to a microstrip log-periodic antenna portion, wherein a dielectric medium is interposed between the slot log-periodic antenna portion and the microstrip log-periodic antenna portion.

2. The RF receiving apparatus of claim 1, further comprising a vehicle.

3. The RF receiving apparatus of claim 2, wherein the vehicle is an air vehicle having a fuselage.

4. The RF receiving apparatus of claim 3, wherein each antenna element of the plurality of antenna elements is disposed conformally about the fuselage in an annular array.

5. The RF receiving apparatus of claim 3, further comprising an air vehicle lifting surface wherein at least one antenna element is conformally disposed on the lifting surface.

6. The RF receiving apparatus of claim 1, further comprising a communications tower having a mast.

7. The RF receiving apparatus of claim 6, wherein each antenna element of the plurality of antenna elements is disposed in an annular ring about the mast.

8. The RF receiving apparatus of claim 1, further comprising a human-portable User interface.

9. A radio frequency (RF) receiving apparatus of claim 1, wherein a first antenna element of the plurality of antenna elements has a first phase center oriented in a first direction; and wherein the plurality of antenna elements further comprises a second antenna element, proximate to the first antenna element, having a second phase center oriented in a second direction substantially opposite the first direction, the second antenna element is a log-periodic antenna element comprising:

a second slot log-periodic antenna portion in planar proximity to a second microstrip log-periodic antenna portion, wherein the dielectric medium is interposed between the second slot log-periodic antenna portion and the second microstrip log-periodic antenna portion.

10. The RF receiving apparatus of claim 9, further comprising a vehicle.

11. The RF receiving apparatus of claim 10, wherein the vehicle is an air vehicle having a fuselage.

12. The RF receiving apparatus of claim 11, wherein each element of the plurality of elements is disposed conformally about the fuselage in an annular array.

13. The RF receiving apparatus of claim 11, further comprising an air vehicle lifting surface wherein at least one element is conformally disposed on the air vehicle lifting surface.

14. The RF receiving apparatus of claim 9, further comprising a communications tower having a mast.

15. The RF receiving apparatus of claim 14, wherein each antenna element of the plurality of antenna elements is disposed circumferentially about the mast.

16. The RF receiving apparatus of claim 9, further comprising a human-portable user interface unit.

17. A radio frequency (RF) transmitting apparatus comprising:

an RF transmitter and a plurality of antenna elements;

wherein a first antenna element of the plurality of antenna elements is a log-periodic antenna element comprising:

a slot log-periodic antenna portion in proximity to a microstrip log-periodic antenna portion, wherein a dielectric medium is interposed between the slot log-periodic antenna portion and the microstrip log-periodic antenna portion.

18. The RF transmitting apparatus of claim 17, further comprising a vehicle.

19. The RF transmitting apparatus of claim 18, wherein the vehicle is an air vehicle having a fuselage.

20. The RF transmitting apparatus of claim 19, wherein each antenna element of the plurality of antenna elements is disposed conformally about the fuselage in an annular array.

21. The RF transmitting apparatus of claim 19, further comprising an air vehicle lifting surface wherein at least one antenna element is conformally disposed on the lifting surface.

22. The RF transmitting apparatus of claim 17, further comprising a communications tower having a mast.

23. The RF transmitting apparatus of claim 22, wherein each antenna element of the plurality of antenna elements is disposed circumferentially about the mast.

24. The RF transmitting apparatus of claim 17, further comprising a human-portable user interface unit.

* * * * *

UNITED STATES PATENT AND TRADEMARK OFFICE

CERTIFICATE OF CORRECTION

PATENT NO. : 7,583,233 B2
APPLICATION NO. : 11/861477
DATED : September 1, 2009
INVENTOR(S) : Mark Russell Goldberg and Harold Kregg Hunsberger It is certified that error appears in the above-identified patent and that said Letters Patent is hereby corrected as shown below:

In the claims:

CLAIM 8, COLUMN 13, LINE 51, change "User" to --user--

Signed and Sealed this
Third Day of December, 2013

Margaret A. Focarino

Margaret A. Focarino
*Commissioner for Patents of the United States Patent and Trademark Office*